US008469376B2

(12) United States Patent
Kristiansen

(10) Patent No.: US 8,469,376 B2
(45) Date of Patent: Jun. 25, 2013

(54) SKATEBOARD

(75) Inventor: Morten Kristiansen, Esbjerg V, (DK)

(73) Assignee: MK Partner Holding APS, Esbjerg (DK)

( * ) Notice: Subject to any disclaimer, the term of this patent is extended or adjusted under 35 U.S.C. 154(b) by 384 days.

(21) Appl. No.: 12/864,011

(22) PCT Filed: Feb. 4, 2009

(86) PCT No.: PCT/DK2009/000028

§ 371 (c)(1),
(2), (4) Date: Oct. 14, 2010

(87) PCT Pub. No.: WO2009/100722

PCT Pub. Date: Aug. 20, 2009

(65) Prior Publication Data

US 2011/0018215 A1 Jan. 27, 2011

(30) Foreign Application Priority Data

Feb. 14, 2008 (DK) ..... 2008 00208
Aug. 21, 2008 (DK) ..... 2008 01138

(51) Int. Cl.
*B62M 1/00* (2010.01)
*A63C 17/06* (2006.01)

(52) U.S. Cl.
USPC ..... 280/87.042; 280/11.27; 280/11.28

(58) Field of Classification Search
USPC ..... 280/87.041, 87.042, 87.03, 87.05, 280/11.27, 11.28
See application file for complete search history.

(56) References Cited

U.S. PATENT DOCUMENTS

| | | | | |
|---|---|---|---|---|
| 4,082,306 | A * | 4/1978 | Sheldon | 280/87.042 |
| 5,540,455 | A | 7/1996 | Chambers | |
| 7,325,819 | B2 * | 2/2008 | Kwak | 280/87.042 |
| 7,775,534 | B2 * | 8/2010 | Chen et al. | 280/87.042 |
| 2006/0055137 | A1 * | 3/2006 | Jiang | 280/87.042 |
| 2006/0163830 | A1 | 7/2006 | Kwak | |
| 2007/0257459 | A1 * | 11/2007 | Gang | 280/87.042 |
| 2007/0273118 | A1 | 11/2007 | Conrad | |

FOREIGN PATENT DOCUMENTS

| | | |
|---|---|---|
| CN | 2211302 Y | 11/1995 |
| CN | 2782172 | 5/2006 |
| EP | 1679101 A | 7/2006 |
| EP | 1511541 | 7/2007 |

(Continued)

OTHER PUBLICATIONS

International Search Report.

(Continued)

*Primary Examiner* — John R Olszewski
(74) *Attorney, Agent, or Firm* — William J. Sapone

(57) ABSTRACT

A skateboard with two wheels (11), said skateboard having a front plate (15) and a rear plate (16) which are connected with each other by a spring element (3), which is secured to a rod (1 and 2) at both ends of the spring element (3). The two wheels (11), the front plate (15) and the rear plate (16) are secured inclined (4) to the rod (8, 11) by means of screw connections (4, 12) to form an angle relative to the upper sides of the plates (15 and 16). In this manner, the front plate (15) and the rear plate (16) are protected against breaks, as the wheels (11) are not secured directly to the front plate (15) and the rear plate (16), but to the rods (1 and 2) with the spring element (13).

10 Claims, 2 Drawing Sheets

FOREIGN PATENT DOCUMENTS

Figure 1:
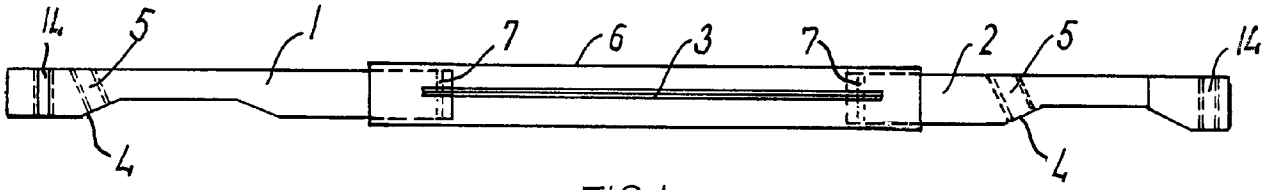

| | | | |
|---|---|---|---|
| KR | 20070084989 | | 8/2007 |
| KR | 20080004939 | | 10/2008 |
| SU | 1405865 | A1 | 6/1988 |
| WO | W02006/129918 | A | 12/2006 |
| WO | W02007/111466 | A | 10/2007 |
| WO | WO2007117092 | | 10/2007 |
| WO | WO2007139356 | | 12/2007 |
| WO | W02008/152365 | A | 12/2008 |
| WO | WO03092831 | | 7/2010 |

OTHER PUBLICATIONS

Danish Search Report.
Chinese Search Report for corresponding China application No. 200980104633.4, undated, 2 pages.

* cited by examiner

SKATEBOARD

THE PRIOR ART

The invention relates to a skateboard comprising a front plate and a rear plate which have one wheel each, and which are connected by means of a spring element.

Such a skateboard is known e.g. from U.S. Pat. No. 5,540,455. The skateboard according to the US patent has a front plate and a rear plate, which are connected with each other by a spring element.

Further, EP 1 511 541 B1 discloses a skateboard of the same type, but having wheels whose axes are inclined and secured directly to the front plate and the rear plate, respectively.

However, it has been found that the front plate and/or the rear plate may crack, if they are subjected to too great loads which are caused by the wheels, as impacts from the wheels are transferred directly to the front plate and the rear plate.

THE OBJECT OF THE INVENTION

It is an object of the invention to remedy this defect.

This is achieved according to the invention in that the skateboard is characterized in that the spring element is formed by an elongated torsional spring, which is secured at each end to a rod, to which the wheels are secured.

In this manner, impacts from the wheels will be transferred to the respective rods thereof and not to the front plate and the rear plate.

When the spring is configured as a leaf spring, a suitable spring characteristic and thereby control of the mutual movability of the plates are achieved.

An expedient way of securing the wheels to the rod is that the two wheels, each of which comprises a bracket as well as a rotary shaft, are secured to their respective threads in their respective rods.

When the wheels are mounted inclined, it is ensured that the wheels are aligned in the travelling direction in use, When the front plate and the rear plate are provided with bushings into which the rods may be inserted and to which they may be secured, a firm assembly of the board without any risk of breaks is ensured.

When the spring is enclosed in a pipe, it is protected, and its function is ensured.

When the wheels are cushioned, the board and thereby the user are not exposed to direct stresses.

Finally, it is expedient to construct the boards so as to allow for the mounting of brake blocks and/or support wheels, as this will protect the boards themselves against wear and moreover facilitate the use.

THE DRAWING

Figure 2:
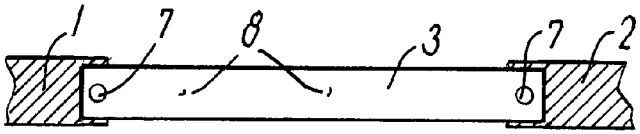
Figure 3:
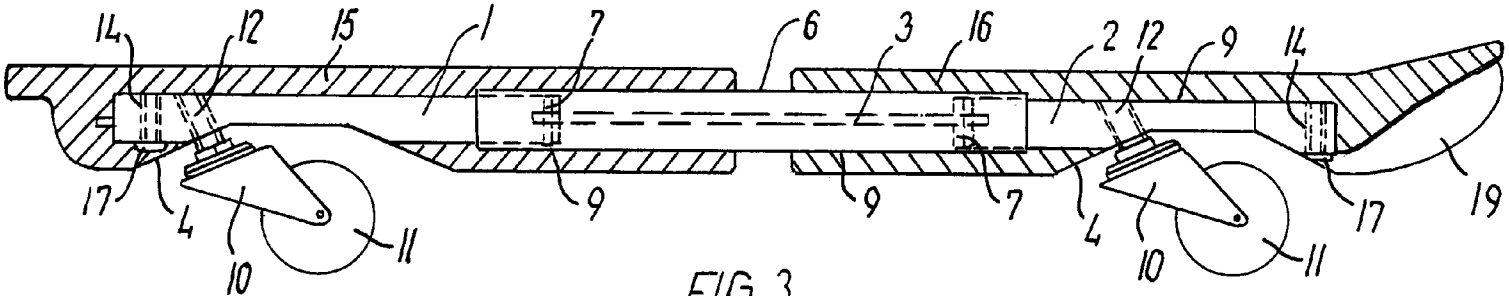
Figure 4:
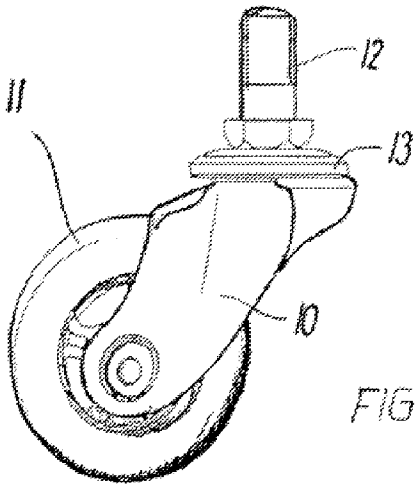
Figure 5:
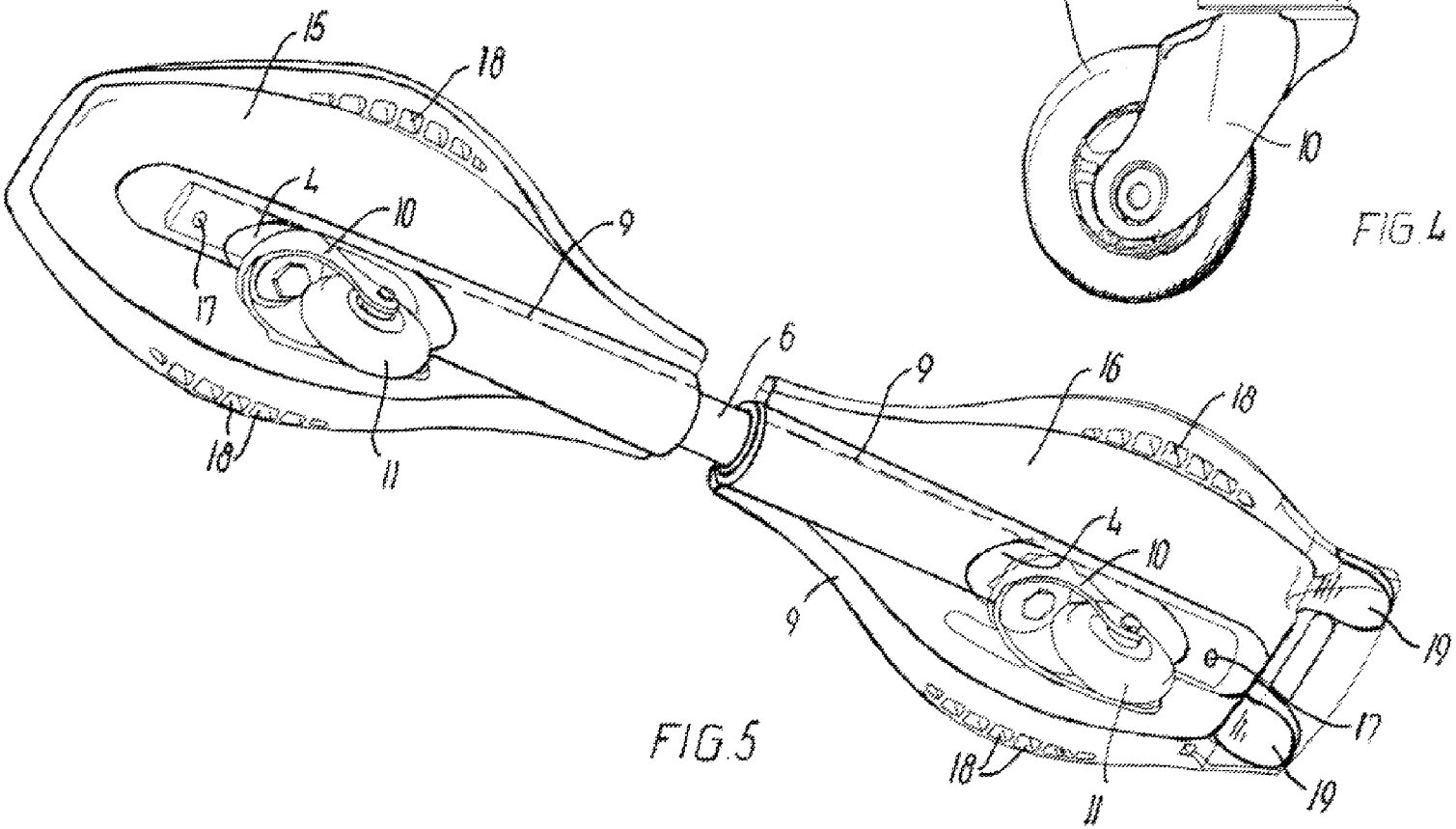

The invention will be described more fully below with reference to the drawing, in which FIG. 1 shows the spring element mounted between two rods, seen from the side, FIG. 2 shows the spring element, seen from above, FIG. 3 shows the skateboard of FIG. 1, seen in a partially sectional view with mounted front plate, rear plate and wheels, FIG. 4 shows a wheel with a bracket and an attachment element, and FIG. 5 shows an assembled skateboard, seen in perspective toward the lower side of the board.

DESCRIPTION OF AN EXEMPLARY EMBODIMENT

The assembled skateboard, which is shown in FIG. 5, will be described below on the basis of the spring arrangement shown in FIGS. 1 and 2.

This spring arrangement comprises a leaf spring 3, which is preferably constructed as a laminate comprising two or more spring members. These spring members are held together, e.g. by a plurality of spot welds 8, and are moreover secured to a rod 1 and 2 at each end by means of a rivet or a screw 7.

This arrangement is preferably enclosed in a pipe member 6, which protects the spring against dust and water.

The rods 1 and 2 are preferably made of aluminium, which is partly light d partly does not corrode.

A shown in FIG. 1, the rods 1 and 2 are provided with a milled-out portion on the lower side, whose one end is inclined 4 in the travelling direction, thereby allowing for the provision of threads 5 in which the wheels may be secured, as will be explained later.

Finally, the outermost parts of the rods are provided with transverse threaded holes 14 into which a screw 17 may be screwed, so that the rods and thereby the entire spring arrangement may be secured to the boards 15 and 16, as shown in FIG. 5.

The two boards 15 and 16 are shown in section in FIG. 3. They are preferably made of plastics, which may be reinforced, as needed, A bushing or bore 9 is provided in the longitudinal direction of the boards, so that each board may be inserted on to a rod 1 and 2 with the spring element 3 in the pipe 6 between them, as shown in FIG. 3.

Then, the rods 1 and 2 may be locked to the boards by means of the previously mentioned bolt or screw 17.

After this, the board is mounted, it being noted that each board may be twisted and moved individually, since they are each secured to a rod 1 and 2 with the spring member 3 between them, The wheels are shown in FIG. 4. They comprise the wheel 11 itself, which is mounted in a bracket 10, which, in turn, is mounted on an attachment element 12.

A spring 13 may be incorporated, in the event that cushioning of the wheels should be needed.

As, shown in FIG. 3, the attachment element 12 is screwed into the threaded holes 5 in the rods, so that the wheels extend obliquely relative to the plates and thereby act self-aligning. It should be noted that the wheels are secured to the rods and not to the boards, whereby the transfer of forces remains between wheel and rod and only affects the boards 15 and 16 indirectly, which are thereby protected against being overloaded with the consequent risk of formation of cracks.

One or more projections or blocks 19 are shown on the rear edge of the rear board 16, which serve as brake blocks when the board is tilted up-wards at the front.

Depressions or recesses 18, as shown in FIG. 5, may be provided on the lower side along the side edges of the boards. Brake blocks and/or support wheels (not shown) may be secured in these.

The skateboard according to the invention may easily be assembled and disassembled by the removal of a few bolts 17, just as the wheels may be easily be removed by screwing out the stay 12.

Hereby, the board may easily be repaired, and the parts may be exchanged, as needed.

The invention claimed is:

1. A skateboard comprising a front plate and a rear plate which each have a wheel assembly, a front rod and a rear rod being secured to each respective plate, each wheel assembly including a wheel, a bracket and a stay (12) about which the wheel is rotatable, each wheel assembly being placed under the respective front plate and rear plate obliquely in relation to the plates, the front and rear plates being connected by a spring element, formed by an elongated torsional spring being secured at each end to the front rod and the rear rod, the front plate (15) and the rear plate (16) each being provided with longitudinal holes, and each having bushings (9) for receiving the respective rods (1 and 2) therein, said rods (1 and 2) being firmly secured (14) to the plates (15 and 16) and each of the stays (12) of each wheel assembly (10, 11) being secured directly to each of the rods (1 and 2).

2. The skateboard according to claim 1, characterized in that the torsional spring (3) is a leaf spring.

3. The skateboard according to claim 2, characterized in that each stay (12) is mounted in a threaded bore located in its respective rod (1 and 2).

4. The skateboard according to claim 2, further comprising a pipe (6), the spring element (3) being completely enclosed and the rods (1 and 2) being partly enclosed in the pipe (6).

5. The skateboard according to claim 1, characterized in that each stay (12) is mounted in a threaded bore located in in its respective rod (1 and 2).

6. The skateboard according to claim 5, characterized in that the threaded bores are inclined relative to upper sides of the front plate (15) and the rear plate (16).

7. The skateboard according to claim 6, characterized in that a shock absorber in the form of a spring (13) is mounted in the bracket (10).

8. The skateboard according to claim 5, characterized in that a shock absorber in the form of a spring (13) is mounted in the bracket (10).

9. The skateboard according to claim 1 further comprising a pipe, the spring element (3) being completely enclosed and the rods (1 and 2) being partly enclosed in the pipe (6).

10. The skateboard according to claim 9, characterized in that depressions or recesses (18) are provided on the lower sides of the plates (15 and 16).

* * * * *